US007946088B1

(12) United States Patent
Fyfe et al.

(10) Patent No.: US 7,946,088 B1
(45) Date of Patent: May 24, 2011

(54) SYSTEM FOR REINFORCING STRUCTURE USING SITE-CUSTOMIZED MATERIALS

(76) Inventors: Edward R. Fyfe, Del Mar, CA (US); Michael Karantzikis, Argiroupolis (GR)

( * ) Notice: Subject to any disclaimer, the term of this patent is extended or adjusted under 35 U.S.C. 154(b) by 288 days.

(21) Appl. No.: 12/321,530

(22) Filed: Jan. 22, 2009

(51) Int. Cl.
*E04B 1/00* (2006.01)

(52) U.S. Cl. ..... 52/344; 52/309.13; 52/309.17; 52/362; 52/413; 52/449

(58) Field of Classification Search ..... 52/344, 52/309.13, 309.14, 309.17, 351, 361, 514.5, 52/741.4, 741.41, 742.16, 745.09, 746.1, 52/745.2, 362, 413, 449, 454; 428/98, 103, 428/104, 111, 139, 140, 223; 156/71, 91, 156/92, 94, 187, 188, 257; 264/257, 258, 264/228, 229

See application file for complete search history.

(56) References Cited

U.S. PATENT DOCUMENTS

| | | | | |
|---|---|---|---|---|
| 4,242,406 | A * | 12/1980 | El Bouhnini et al. | 442/373 |
| 4,841,705 | A * | 6/1989 | Fuhrer | 52/410 |
| 7,207,149 | B2 * | 4/2007 | Fyfe et al. | 52/698 |
| 2002/0090871 | A1 * | 7/2002 | Ritchie et al. | 442/42 |
| 2004/0025465 | A1 | 2/2004 | Aldea et al. | |

* cited by examiner

*Primary Examiner* — Brian E Glessner
*Assistant Examiner* — Patrick Maestri
(74) *Attorney, Agent, or Firm* — Mary Jo Redman; Calif Tervo; Palomar Patent

(57) ABSTRACT

System and method for reinforcing structures includes basalt textile 20 connected to surfaces of the structure 100 with fiber anchors 30. Textile spreads forces and increases ductility of structure. Textile may connect multiple structural elements together, including walls, floors, columns, beams, and roofs. Textile is covered with mortar 50 customized to match color and texture of structure by use of locally obtained grit, aggregate, or colorant. Basalt fiber textile is preferred to avoid degradation of textile from alkaline components of mortar 50.

12 Claims, 1 Drawing Sheet

SYSTEM FOR REINFORCING STRUCTURE USING SITE-CUSTOMIZED MATERIALS

FIELD OF THE INVENTION

The present invention relates in general to reinforcing structures and more particularly to materials for strengthening existing structures without substantial change to the appearance of the structures.

BACKGROUND OF THE INVENTION

Many existing buildings throughout the world are in need of reinforcement to help them resist damage by earthquake, violent storms, acidic atmosphere, vibrations due to vehicle traffic, or similar threats. Many older buildings, especially, were designed to handle large compressive forces but are not resistant to lateral forces.

Buildings that are not resistant to sudden lateral force need to be reinforced for the safety of people who live or work in, or visit the building. Some buildings have considerable historical or artistic value and must be protected from disasters and environmental deterioration for their own sakes.

Some methods exist for reinforcing existing buildings. One that is used all over the world is wrapping a structure with fiberglass textile that is impregnated with epoxy. This method is taught in different forms in U.S. Pat. Nos. 5,043,033, 5,649,398, and 5,657,595. A means of connecting different components of a structure is taught in U.S. application Ser. No. 10/205,294, filed Jul. 24, 2002 and incorporated herein by reference.

The methods of U.S. Pat. Nos. 5,043,033, 5,649,398, and 5,657,595 are effective and can be performed with little intrusion on the occupants and visitors of the building being reinforced. A disadvantage to these methods is that they use some specialized materials that are not readily available in all locations. As a result, the materials are shipped from centralized distribution centers, sometimes to remote locations that are difficult to reach. The shipping and round transportation of heavy materials adds significantly to the cost of the project.

Another disadvantage of the wrapping methods is that the materials readily available on the market are not good matches in color and texture with old buildings. There are many buildings all over the world that are constructed of native stone, brick from local clay, or that are coated with plaster made with local minerals. As a result, the materials of the methods mentioned above, such as epoxy and fiberglass, may not match the color or texture of a given building.

Yet another disadvantage to the method discussed above is that some of the materials, particularly epoxy, are less fire resistant than conventional stone, brick, or plaster construction. It is desirable that a method for increasing a building's strength should also increase its fire-resistance, or at least not degrade it.

To avoid the disadvantage of the flammability of epoxy or other organic polymers, the textile could be coated with an inorganic hardenable paste such as mortar. However, this leads to a different disadvantage, which is that inorganic mortars are alkaline and tend to degrade ordinary fiberglass. Special alkaline-resistant glass textile is available, but is quite expensive. This incompatibility has discouraged the use of glass textile with mortar for reinforcement of structures. Graphite carbon or aramid fiber textiles would be compatible with mortar, but these textiles are also very expensive and not widely available in all countries.

SUMMARY OF THE INVENTION

The present invention is a system of materials and methods for reinforcing structures using some locally derived materials. The system includes a textile wrap attached to the structure with fiber anchors and a finishing layer of mortar made with grit and aggregate that was obtained from sources in the vicinity of the structure being reinforced.

The textile is composed of fibrous basalt, which is resistant to alkaline and compatible with inorganic mortar. The textile is typically an open-weave fabric that is strong and ductile. The fabric is attached to the structure in a ductile manner, such as with fiber anchors. The fiber anchors are preferably also created from basalt fiber.

A mortar finishing material is mixed, beginning with a hardenable liquid matrix, such as slurry of calcined mineral particles that harden to create a solid mortar after being mixed with water. Grit, aggregate, or both are added to the hardenable liquid matrix. The grit or aggregate add color and texture to the mortar finishing material.

The reinforcing system is intrinsically fire resistant and does not increase the fire risk to a structure.

By using grit and aggregate that are mined or quarried locally, it is often possible to match the color and texture of the original building very well. The final appearance of the reinforced structure is relatively unchanged from the original, possibly historic, appearance. Further, the ability to use local mineral materials saves money on shipping material to a remote location.

Utilizing local minerals for the mortar finishing material is made possible by the use of basalt fiber textile and fiber anchors.

DETAILED DESCRIPTION OF THE INVENTION

Figure 1:
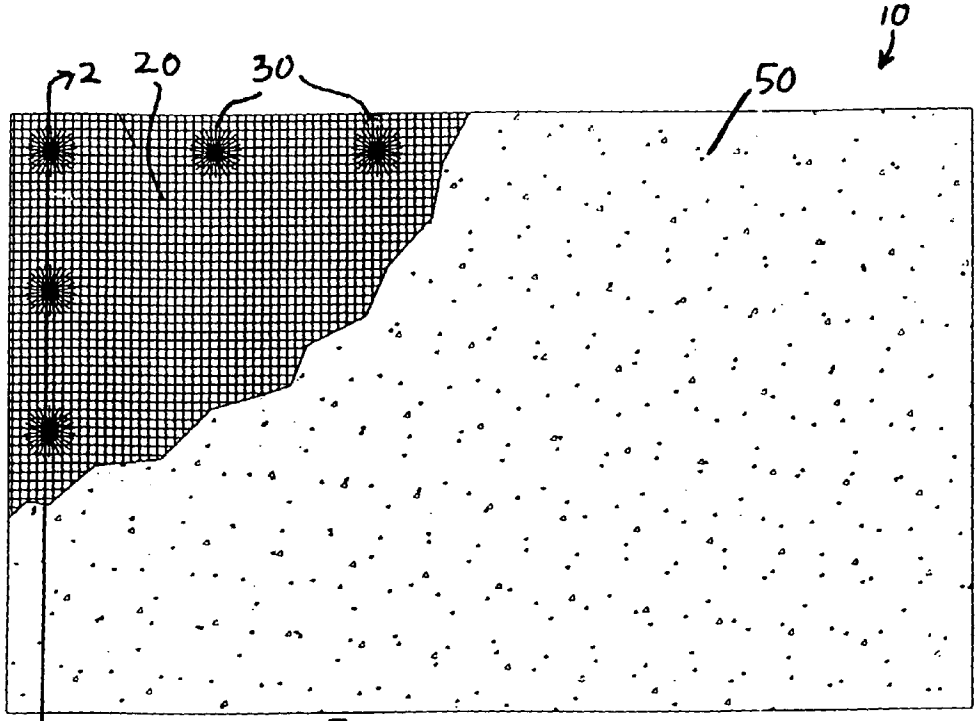
FIG. 1 is a top plan view, partly cut away, of the reinforcement system of the present invention, as used to strengthen a wall of a building.
Figure 2:
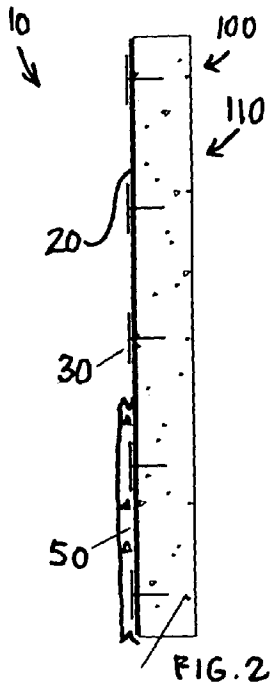
FIG. 2 is a sectional view, taken on line 2-2 of FIG. 1.

FIG. 1 is a top plan view of the reinforcement system 10 of the present invention, partly cut away. FIG. 2 is a sectional view of reinforcement system 10, taken on line 2-2 of FIG. 1, as used to strengthen a structure 100, for example a wall 110 of a building.

Reinforcement system 10 include alkaline-resistant textile 20 stretched over wall 110. Textile 20 is attached to wall 110 with a plurality of fiber anchors 30. A mortar 50, containing mineral products obtained in the same geographic region as structure 100, is spread over textile 20 and fiber anchors 30.

Textile 20 is preferably a lightweight, open weave fabric, composed of suitable ductile, strong, and alkaline resistant fibers such as basalt. Conventionally, structures have been reinforced with fabrics made of glass fibers. Ordinary glass fabric must be covered with a protective finishing material that is pH neutral, that is, neither strongly alkaline nor acidic. Many alkaline or acidic materials, including cementitious materials such as mortar and concrete, degrade glass and weaken it. For this reason, structural reinforcing systems that include glass fiber fabric also typically include a finishing layer of epoxy or polyurethane, which are substantially neutral.

Of course, other alkaline-resistant fibers with good ductility and high tensile strength may be used to create textile 20 in place of basalt. The choice of specific fiber for textile 20 may be made for each application based upon availability, strength, and cost.

Test results show that system 10 greatly increases the load-bearing ability of wall 110 even if the weave of textile 20 includes openings as wide as three or four inches across. A plain or twill weave with square or rectangular openings has been found to be convenient to apply and to provide sufficient strength and ductility. Textile 20 is typically woven from yarns or bundles consisting of many individual thin filaments of basalt fiber.

Textile 20 is stretched over surfaces of various structural elements of a structure 100 to be reinforced. Panels of textile 20 may be wrapped over interior or exterior corners so as to connect different walls 110, or to connect a wall 110 to a ceiling, or other combinations as appropriate. Textile 20 may be temporarily attached to wall 110 by suitable clips, staples, or adhesive.

Many types of structural element can be reinforced by using textile 20 to connect walls 110 to floors or ceilings, columns or beams to ceilings, roofs to walls 110, and so on.

The next step in the reinforcement method is to permanently attach textile 20 to wall 110 or other structure using suitable ductile connecting means, such as a plurality of fiber anchors 30, as are well known in the art. Fiber anchors 30 are created by boring a hole through an opening in textile 20 and into the underlying wall 110. A length of fiber roving, preferably also composed of fibrous basalt, is inserted into the borehole with a free end extending above textile 20.

A backfill material, such as grout or polymeric adhesive, is pushed or injected into the borehole. The free end of the roving is attached to the outer surface of wall 110 and over textile 20, such as with adhesive or mortar. The backfill material retains the roving within the borehole such that fiber anchor 30 forms a sort of large pin attaching textile 20 to wall 110. Fiber anchor 30 is the most preferred ductile connecting means for system 10 because fiber anchor 30 spreads forces over a broad area and so is unlikely to pull out from wall 110 as a mechanical fastener might, or pull off a section of wall 110 as a surface adhesive might.

The final process is to cover textile 10 and fiber anchors 30 with a mortar finish coat 50. Mortar finish coat 50 covers textile 20 so that it will not be damaged by weather, or snagged. Mortar 50 contacts and adheres to the original surface of wall 110 through the openings of the weave of textile 20, embedding textile 20 and helping spread any large lateral forces such as from earthquake or wind. Mortar 50 mechanically holds textile 20 in place near wall 110 but cannot take the place of ductile connection means such as fiber anchors 30.

Mortar finish coat 50 is largely for creating a uniformly textured and colored surface for the reinforced wall 110. Conventional epoxy and glass fiber textile reinforcement typically gives a structure a smoother texture and slightly hazy coloration. Although the epoxy can be covered with paint of other finish, mortar is not advised due to possible degradation of the glass fiber.

Mortar finish coat 50 works well for replicating the appearance of original concrete, stucco, or plaster walls 110. With additional modeling and coloring work, mortar finish 50 can even replicate the appearance of historical stone or brick walls 110.

Mortar 50 is customized to suit the structure to be reinforced. Typically, mortar 50 is based on a matrix of hardenable paste, such as ductile concrete. Uncured ductile concrete may be termed a slurry, that is, a mixture of solid particles suspended in a liquid, with sufficient viscosity or surface tension that the particles remain suspended for a long time and yield a mixture that can be handled like a liquid or paste.

Ductile concrete is not typically used as a finish coat for homes, historical buildings, or other structures where appearance is important but a modern "industrial" look is not desired. However, it is a strong, ductile material that is less likely to crack under lateral forces than standard concrete.

Other matrix materials such as organic polymers or other inorganic cementitious materials may also be used to create mortar 50.

Generally, building materials such as stone, brick, and adobe are not transported farther than necessary. As a result, structures in a given country or geographic area tend to have distinctive appearances. To customize mortar 50, it is preferred that mineral materials are used that are similar to those used for the structure originally.

For example, many older public buildings in the American Midwest are of the tan stone call Indiana limestone. In the American Southwest, many historical buildings are of adobe bricks, which vary in color depending upon the iron content of the local clay.

Thus, to reinforce a structure in the Midwest it might be appropriate to incorporate ground limestone into mortar 50 to produce a smooth tan surface on the reinforced structure. In the Southwest, adobe clay or ground sandstone might be added to mortar 50 to make it resemble brick or stone.

Mineral materials obtained locally may include sand, clay, gravel, ground stone, or mineral colorants. Although the minerals used for customized mortar finish coat 50 are described herein as locally obtained, it is to be understood that the mineral materials are to be obtained preferably from the same source as the materials of the original structure. For example, if an historical structure in Indonesia was built originally of imported Italian marble, it may be aesthetically desirable to obtain material from the same quarry in Italy to customize mortar 50 if reinforcing the structure in Indonesia.

Figure 3:
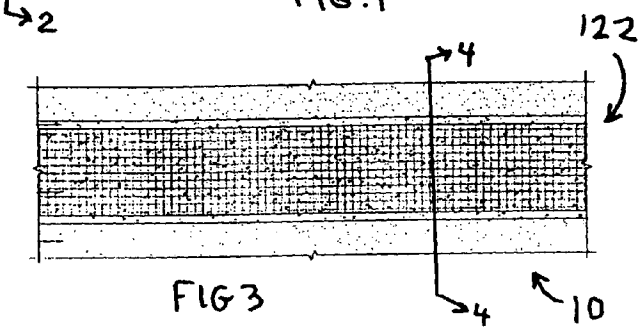
FIG. 3 is a top plan view of the reinforcement system of the present invention, as used to strengthen an expansion joint of a structure.
Figure 4:
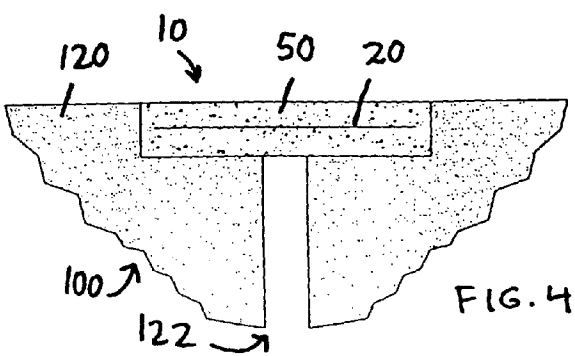
FIG. 4 is a sectional view, taken on line 4-4 of FIG. 3.

An alternative embodiment of reinforcing system 10 is illustrated in FIGS. 3 and 4. FIG. 3 is a top plan view of reinforcement system 10, as used to strengthen an expansion joint 122 of a structure, such as a bridge 120. FIG. 4 is a sectional view; taken on line 4-4 of expansion joint 122 of FIG. 3.

Expansion joint 122 is a design feature of bridge 120. It is a gap of a few inches width, left between sections of bridge 120 to allow for thermal expansion of the bridge material. The gap of expansion joint 122 is typically filled to provide a smooth surface for traffic.

The filling of expansion joint 122 must be of a material that is ductile and will not interfere with the function of expansion joint 122. The alternative embodiment of reinforcing system 10 as illustrated in FIGS. 3 and 4 has been found to be a low cost and very effective way of dressing expansion joint 122.

Expansion joint 122 has been created with a recess 125 to be filled to provide a smooth upper surface. To fill expansion joint 122 using system 10 of the present invention, a first layer of mortar 50 is laid into recess 125, filling recess 125 approximately halfway. Next, a strip of textile 20, as described above, is laid over mortar 50. A second layer of mortar 50 is poured or spread over textile 20 to fill recess 125 to the desired level. Mortar 50 may be textured as desired or left in the as-applied state. Fiber anchors 30 are typically not required for this embodiment of system 10.

It may be noted that reinforcement system 10, as practiced for reinforcing structures such as buildings, may be optionally installed similarly to the method of filling expansion joints 122. That is, a first layer of mortar 50 may be spread on the original wall 110 of the structure, then textile 20 attached over the first layer of mortar 50. Fiber anchors 30 are preferably still employed as detailed above. A second layer of mortar 50 is applied over textile 20 and finished, also as described above.

Although particular embodiments of the invention have been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

We claim:

1. A method of reinforcing structures; including the steps of:

attaching a fabric composed of alkaline-resistant fibers to a surface of the structure to be reinforced with ductile attachment means;

spreading a layer of a hardenable slurry over the attached fabric such that the slurry covers and embeds the fabric; the slurry including mineral particles that are similar in texture, color, or both, to the original surface of the structure wherein the step of attaching the fabric to the surface with ductile attachment means comprises the sub-steps of: boring a hole through the alkaline-resistant fabric and into the structure; inserting a length of fiber roving into the borehole, with a free end protruding above the fabric; backfilling the borehole with suitable backfill material; and attaching the free end of the roving to the surface being reinforced and over the fabric with a suitable adhesive.

2. The method of claim 1, the step of spreading a layer of hardenable slurry over the fabric comprising:

spreading a slurry containing cementitious or polymer matrix and further including mineral materials quarried in a location geographically close to the structure to be repaired.

3. The method of claim 2, the step of spreading a slurry containing sand, ground rock, or minerals comprising:

spreading a slurry including sand, ground rock, or mineral materials that produce a finished appearance substantially the same in color and texture as the original surface of the structure.

4. A method of reinforcing a structure including the steps of:

creating a customized surface finishing mortar by mixing mineral materials with a hardenable fluid matrix; the customized surface finishing mortar formulated so as to produce a finished appearance substantially the same in color and texture as the original surface of the structure;

spreading a fabric composed of alkaline-resistant fibers over surfaces of the structure to be reinforced;

attaching the fabric to the structure by ductile attachment means;

spreading a layer of customized surface finishing mortar over the attached fabric; wherein the step of attaching the fabric to the surface with ductile attachment means comprises the sub-steps of: boring a hole through the alkaline-resistant fabric and into the structure; inserting a length of fiber roving into the borehole, with a free end protruding above the fabric; backfilling the borehole with suitable backfill material; and attaching the free end of the roving to the surface being reinforced and over the fabric with a suitable adhesive.

5. The method of claim 4; the step of creating a customized surface finishing mortar further including: obtaining mineral materials from a source geographically local to the structure.

6. The method of claim 4, the step of spreading a fabric comprising:

spreading a fabric composed of alkaline-resistant fibers over one or more surfaces of the structure to be reinforced.

7. The method of claim 4, wherein the step of creating a customized surface finishing material includes the sub-steps of:

obtaining a suitable hardenable fluid matrix from the group of: cementitious mortar, ductile cement, epoxy, polyurethane, or acrylic.

8. The method of claim 4, wherein the structure to be reinforced is a historical building that must substantially retain its original appearance after being reinforced.

9. The method of claim 4, the step of spreading a fabric comprising:

spreading a fabric composed of basalt fibers over one or more surfaces of the structure to be reinforced.

10. A system for reinforcement of a structure; including:

alkaline-resistant textile wrapped over or around a structural element of the structure to be reinforced;

ductile connecting means for connecting said textile to the structural element wherein said ductile connecting means comprises a plurality of fiber anchors; and a mortar layer including:

mineral materials selected to match the existing color, texture, or both of the structure.

11. The system of claim 10, said alkaline-resistant textile comprising: a fabric woven from fibers of basalt.

12. The system of claim 10, said alkaline-resistant textile comprising: a fabric woven or knit from high-strength fibers of basalt, alkaline-resistant glass, polyaramide, or carbon.

* * * * *